US009899167B2

(12) United States Patent
Florez et al.

(10) Patent No.: US 9,899,167 B2
(45) Date of Patent: Feb. 20, 2018

(54) ELECTRICAL SWITCHING DEVICE

(71) Applicant: ABB Schweiz AG, Zürich (CH)

(72) Inventors: Javier Mantilla Florez, Baden (CH); Xiangyang Ye, Nesselnbach (CH); Mahesh Dhotre, Brugg (CH); Oliver Cossalter, Fislibach (CH); Stephan Grob, Baden (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/191,287

(22) Filed: Jun. 23, 2016

(65) Prior Publication Data

US 2016/0307716 A1 Oct. 20, 2016

Related U.S. Application Data

(63) Continuation of application No. PCT/EP2014/078975, filed on Dec. 22, 2014.

(30) Foreign Application Priority Data

Dec. 23, 2013 (WO) ..... PCT/EP2013/077960

(51) Int. Cl.
*H01H 33/02* (2006.01)
*H01H 33/22* (2006.01)
(Continued)

(52) U.S. Cl.
CPC ..... *H01H 33/021* (2013.01); *H01B 3/56* (2013.01); *H01H 33/22* (2013.01);
(Continued)

(58) Field of Classification Search
CPC .. H01H 33/021; H01H 33/22; H01H 33/7015; H01H 33/74; H01H 33/60; H01H 33/903; H01H 33/91; H01L 33/56
(Continued)

(56) References Cited

U.S. PATENT DOCUMENTS 6,872,907 B2 * 3/2005 Claessens ..... H01H 33/7015 218/43
8,779,316 B2 * 7/2014 Drews ..... H01H 33/74 218/51
(Continued)

FOREIGN PATENT DOCUMENTS

DE 20 2009 009 305 U1 11/2009
EP 1768150 A1 3/2007
(Continued)

OTHER PUBLICATIONS

European Patent Office, International Search Report & VVritten Opinion issued in corresponding Application No. PCT/EP2014/078975, dated May 12, 2015, 11 pp.
(Continued)

*Primary Examiner* — Renee Luebke
*Assistant Examiner* — William Bolton
(74) *Attorney, Agent, or Firm* — Taft Stettinius & Hollister LLP

(57) ABSTRACT

An electrical switching device is filled with a dielectric insulating medium comprising an organofluorine compound, in particular a fluoroether, a fluoroarnine, a fluoroketone or a fluoroolefin, and comprises at least an arcing contact arrangement with a first arcing contact and a mating second arcing contact. At least a first intermediate volume is provided downstream from the first arcing contact, and/or at least a second intermediate volume is provided downstream from the second arcing contact. The intermediate volumes are for intermediate pressure enhancement and exhaust gas jet formation for turbulent convective heat transfer to metal walls of the exhaust system. In embodiments, the first and/or second intermediate volume is delimited by at least one moveable wall arranged transversally to the longitudinal axis and shiftable parallel to it by an actuation device.

41 Claims, 4 Drawing Sheets

Figure 1:
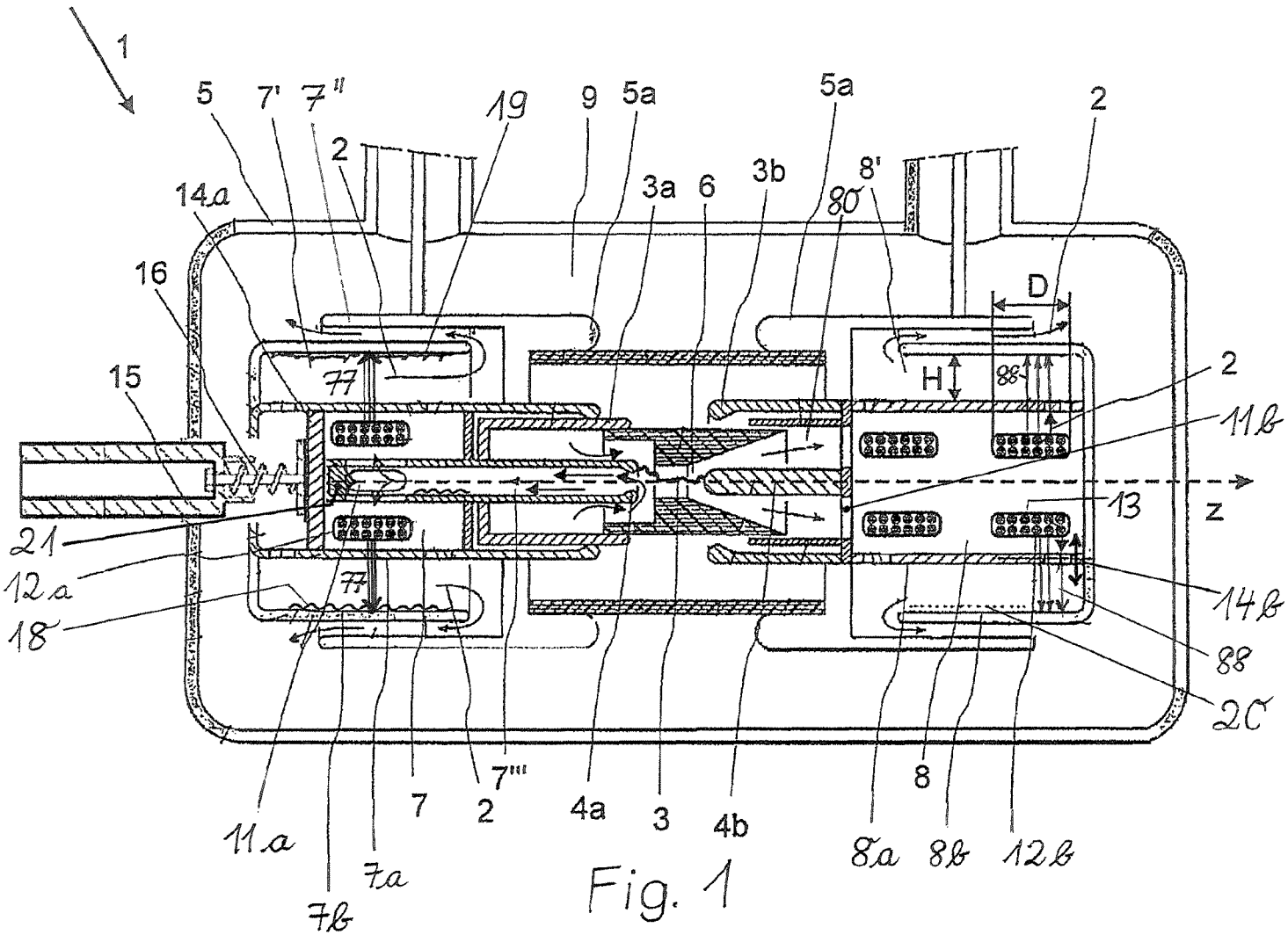

(51) Int. Cl.

| | |
|---|---|
| ***H01H 33/70*** | (2006.01) |
| ***H01H 33/74*** | (2006.01) |
| ***H01H 33/88*** | (2006.01) |
| ***H01B 3/56*** | (2006.01) |

(52) U.S. Cl.
CPC ..... *H01H 33/7015* (2013.01); *H01H 33/74* (2013.01); *H01H 2033/888* (2013.01); *H01H 2235/01* (2013.01)

(58) Field of Classification Search
USPC ..... 218/155, 59, 57, 61, 91, 90, 97
See application file for complete search history.

(56) References Cited

U.S. PATENT DOCUMENTS

2005/0150868 A1* 7/2005 Nowakowski ..... H01H 33/7015 218/57
2007/0068904 A1 3/2007 Dahlquist et al.
2010/0147804 A1* 6/2010 Yamada ..... H01H 33/90 218/63
2011/0278263 A1* 11/2011 Mantilla ..... H01H 33/903 218/140
2012/0145521 A1 6/2012 Glasmacher

FOREIGN PATENT DOCUMENTS

WO 2006066420 A1 6/2006
WO 2013087687 A1 6/2013
WO 2013136015 A1 9/2013

OTHER PUBLICATIONS

European Patent Office, lnternational Search Report & Written Opinion issued in corresponding Application No. PCT/EP2013/077960, dated Sep. 9, 2014, 11 pp.

* cited by examiner

ELECTRICAL SWITCHING DEVICE

TECHNICAL FIELD

The invention is in the field of medium and high voltage switching technologies and relates to an electrical switching device and a method for operating it according to the independent claims, particularly for a use as an earthing device, a fast-acting earthing device, a circuit breaker, a generator circuit breaker, a switch disconnector, a combined disconnector and earthing switch, or a load break switch in power transmission and distribution systems.

BACKGROUND

Electrical switching devices are well known in the field of medium and high voltage switching applications. They are e.g. used for interrupting a current when an electrical fault occurs. As an example for an electrical switching device, circuit breakers have the task of opening contacts and keeping them far apart from one another in order to avoid a current flow, even in case of high electrical potential originating from the electrical fault itself. For the purposes of this disclosure the term medium voltage refers to voltages from 1 kV to 72.5 kV and the term high voltage refers to voltages higher than 72.5 kV. The electrical switching devices, like said circuit breakers, may be rated to carry high nominal currents of 4000 A to 6300 A and to switch very high short circuit currents of 40 kA to 80 kA at very high voltages of 110 kV to 1200 kV.

Because of the high nominal current, the electrical switching devices of today require many so-called nominal contact fingers for the nominal current. When disconnecting (opening) a nominal or short circuit current within the electrical switching devices, the current commutates from nominal contacts of the electrical switching device to its arcing contacts. As well, when connecting (closing) the nominal contacts of the electric switching device, the arcing contacts are connected in advance. In embodiments the arcing contacts comprise, as a first arcing contact, arcing contact fingers arranged around the longitudinal axis of the electrical switching device in a so-called arcing finger cage and, as a second arcing contact, a rod or pin which is driven into the finger cage.

During the opening process of the electrical switching device an electric arc forms between the first and the second arcing contact, an area being called arcing volume, which arc is conductive and still carries electric current even after the opening or physical separation of the arcing contacts. In order to interrupt the current, the electrical switching devices contain a dielectrically inert fluid used as a dielectric insulating medium and for quenching the electric arc as fast as possible. Quenching the electric arc means extracting as much energy as possible from it. Consequently, a part of the fluid located in the area where the electric arc is generated is considerably heated up (to around 20'000° C. to 30'000° C.) in a very short period of time. Because of its volume expansion this part of the fluid builds up a pressure and is ejected from the arcing volume. In this way the electric arc is blown off around the instant when the current is zero. The fluid flows into one or more exhaust volumes where it is cooled and redirected by a cooling device. Mixing with the cold fluid located in the exhaust volume or volumes is only possible to a relatively small extent, because the predominant part of the cold gas present inside the respective exhaust volume is pressed out of the exhaust volume by the hot fluid, which expands out of the arcing volume, before any significant mixing can occur. When the hot exhaust fluid comes into electric-field-stressed regions, e.g. close to shieldings, unwanted dielectric flashovers may occur, as the dielectric withstand capabilities of the exhaust fluid is typically lower at higher temperatures. It is therefore necessary to cool down the exhaust fluid as much as possible before it travels into such electric-field-stressed regions of the exhaust volume(s).

In EP 1 403 891 A1 of the same applicant, an $SF_6$-gas-blast circuit breaker is disclosed in which $SF_6$-exhaust-gas from an arcing area is passed through a hollow contact into a concentrically arranged exhaust volume, and from there into a switching chamber volume located further outward. For improved $SF_6$-exhaust-gas cooling, at least one intermediate volume and possibly an additional volume is or are arranged concentrically between the hollow contact and the exhaust volume and are separated from one another by intermediate walls. The intermediate walls generate an increased intermediate $SF_6$-exhaust-gas pressure and have holes or openings for forming $SF_6$ gas jets. The $SF_6$-exhaust-gas jets then impact on opposite walls opposing the openings and are swirled intensively at the opposing walls. Thus, the $SF_6$-exhaust-gas is cooled by radially flowing out the SF6-switching-gas from the inner to the outer volumes through a sequence of jet-forming openings and jet-swirling opposing baffle walls, and thus a large amount of thermal energy is transferred to walls of the volumes in the exhaust system.

The openings between the hollow-contact volume, the intermediate volume and, if appropriate, the additional volume are arranged offset with respect to one another on the circumference. The openings between the additional volume and the exhaust volume are arranged offset with respect to one another on the circumference and/or in the axial direction. This also results in meandering as well as spiralling $SF_6$-exhaust-gas paths being predetermined, with the dwell time for which the $SF_6$-exhaust-gas remains in the exhaust area being increased, and with the heat transfer from the $SF_6$-exhaust-gas being further improved. Furthermore, the holes can be covered by means of panels in the form of perforated metal sheets to produce a larger number of radially directed $SF_6$-exhaust-gas streams or $SF_6$-exhaust-gas jets. These $SF_6$-exhaust-gas jets again strike the opposite wall, are swirled at the impact points, and thus intensively cool the hot $SF_6$ exhaust gas. The intermediate volume, which improves the cooling, is arranged in the exhaust area on the drive contact side. A second intermediate volume may also be provided on the fixed-contact side. Overall, at least one intermediate volume is additionally required in the circuit breaker, that is to say in addition to the hollow-contact volume, the exhaust volume and the switching chamber volume, in order to achieve efficient $SF_6$-exhaust-gas cooling.

In WO 2006/066420 of the same applicant, an $SF_6$-gas-blast generator circuit breaker with a similar exhaust gas system is disclosed, which has intermediate walls with openings for $SF_6$-exhaust-gas jet formation and opposing walls with baffle-wall and heat-sink function for vortex heat transfer of the $SF_6$-exhaust-gas to such opposing walls.

In WO 2010/142346 of the same applicant, a gas-blast circuit breaker with a novel arc-exctinguishing insulation fluid comprising fluoroketones is disclosed. High voltage circuit breakers having a heating chamber for providing a self-blasting effect can be operated with such fluoroketones and specifically C6-fluoroketones. Such fluoroketones are disclosed to beneficially increase the self-blasting pressure in the heating chamber during a back-heating phase in a switching operation, as they are decomposed to a larger number of fluorocarbon compounds having a lower number of carbon atoms. Inside the arcing region, a favourable arc extinction capability of fluoroketones having from 4 to 12 carbon atoms is at least partially attributed to the recombination of the dissociation products of the fluoroketones mainly to tetrafluoromethane ($CF_4$), which is a highly potent arc extinction medium. Moreover, C6-fluoroketones are disclosed to be useful for limiting the exhaust gas temperature in the whole vessel and in the exhaust volumes during and after arc interruption, because decomposition of sufficiently present C6-fluoroketone molecules absorbs the excess thermal energy and prevents further exhaust-gas heating beyond the decomposition temperature of around 550° C. to 570° C.

In WO 2012/080246 of the same applicant, a gas-blast circuit breaker with arc-exctinguishing insulation fluids comprising C5-fluoroketones is disclosed. The C5-fluoroketones have a non-linear increase of dielectric strength in mixtures with certain carrier gases, such as nitrogen and carbon dioxide. The C5-fluoroketones again provide a beneficial blasting-pressure increase in the compression chamber and/or heating chamber and/or arcing region during an arc-extinguishing phase due to molecular decomposition. In addition, recombination of C5-fluoroketone to tetrafluoromethane ($CF_4$) in the arcing region is beneficial for arc extinction. As mentioned, molecular decomposition is also beneficial in the exhaust region, because the rather low dissociation temperatures of the fluoroketones of about 400° C. to about 600° C. or even 900° C. can function as a temperature barrier in the exhaust gas.

In both WO 2010/142346 and WO 2012/080246, the decomposition of fluoroketones in the heating chamber, compression or puffer chamber, arcing region and exhaust volumes are considered to be beneficial for the circuit breaker performance and in particular for the exhaust gas cooling.

In DE 10 2011 083 588 A1 an exhaust system with at least two concentric exhaust tubes is disclosed. The exhaust tubes have large numbers of radial (mantle-sided) over-pressure relief openings that are mutually off-set to one another such that direct radial gas outflow through both exhaust tubes is blocked. The relief openings may be arranged such that the exhaust gas is forced to enter the first and second exhaust tube repeatedly. Also axial (end-sided) non-overlapping over-pressure relief openings are disclosed and may e.g. be on opposite end faces of the first and second exhaust tube. An armature body can be provided, which is shiftable or dimensionally adaptable to hide or clear openings and thus to adapt the cooling capacity. Overall, exhaust gas is cooled by providing a long meandering (i.e. alternatingly radial and axial) gas path, by providing a very large number and density of openings, and also by providing each opening with an opposing baffle wall section for better mixing the exhaust gas.

In U.S. Pat. No. 7,763,821, a puffer-type gas-blast circuit breaker is disclosed which has a moveable hollow arcing contact with a radial opening for releasing exhaust gases in radial direction. The drive rod for the hollow arcing contact carries a gas blocking member for preventing axial gas discharge towards the drive unit.

DESCRIPTION OF THE INVENTION

It is an objective of the present invention to improve exhaust gas cooling in an electrical switching device. This objective is achieved by the subject-matter of the independent claims. Embodiments are disclosed in the dependent claims, any claim combinations thereof, and in the description together with the figures.

A first aspect of the invention related to an electrical switching device having a longitudinal axis z, comprising an arcing volume and at least an arcing contact arrangement with a first arcing contact and a mating second arcing contact, and further comprising an exhaust system with at least one exhaust volume, wherein for closing and opening the electric switching device at least one of the arcing contacts is movable parallel to the longitudinal axis z and cooperates with the other arcing contact, wherein the electrical switching device comprising a dielectric insulating medium comprising an organofluorine compound selected from the group consisting of: a fluoroether, a fluoroamine, a fluoroketone, a fluoroolefine, and mixtures thereof, and inside the exhaust volume at least one intermediate volume is arranged, is enclosed by an intermediate wall, comprises at least one inlet opening for receiving exhaust gas coming from the arcing region, and comprises at least one outlet opening, which outlet opening is facing an opposing wall, in particular of the exhaust volume, and is for producing at least one exhaust gas jet and for discharging it towards and impacting it on the opposing wall.

In embodiments, the impacting causes swirling the at least one exhaust gas jet, which swirling induces turbulent-gas heat transfer to the opposing wall and reduces a temperature and pressure of the swirling exhaust gas jet.

In embodiments, the organofluorine compound is selected from the group consisting of: perfluoroether, hydrofluoroether, perfluoroamine, perfluoroketone, perfluoroolefin, hydrofluoroolefine, and mixtures thereof; in particular, such organofluorine compound can be in mixtures with a background gas and more particularly in a mixture with a background gas compound selected from the group consisting of: air, air components, nitrogen, oxygen, carbon dioxide, nitrogen oxides.

In embodiments, the dielectric insulating medium comprises as the organofluorine compound a fluoroketone having from 4 to 15 carbon atoms. The fluoroketone can be selected from the group consisting of: fluorketones having exactly 5 carbon atoms, fluorketones having exactly 6 carbon atoms, fluorketones having exactly 7 carbon atoms, fluorketones having exactly 8 carbon atoms, such fluoroketones with at least one of the mentioned carbon atoms being replaced by a heteroatom, in particular being replaced by nitrogen and/or oxygen and/or sulphur, and mixtures thereof.

In embodiments, the intermediate volume is designed such that during operation, in particular during a time period of exhaust gas ejection,

- an exhaust gas pressure is decreasing along a travel path of the exhaust gas from the arcing region through the exhaust system; and/or
- an intermediate exhaust gas pressure $p_7$; $p_8$ in the intermediate volume exceeds a pressure in the volumes which are downstream of the intermediate volume in the travel path of the exhaust gas through the exhaust system; and/or
- an exhaust gas pressure in the at least one intermediate volume is increased compared to when the at least one intermediate volume were not present.

In embodiments, the intermediate volume is designed such that at least temporarily during a time period of exhaust gas ejection an intermediate exhaust gas pressure $p_7$; $p_8$ in the intermediate volume exceeds an exhaust gas pressure in its immediately succeeding exhaust volume at least by a pressure ratio K larger than 1.1, in particular the pressure ratio K being selected from the group consisting of: a first pressure ratio $K_7$, a first further pressure ratio $K_f$, a second pressure ratio $K_8$, and combinations thereof.

In embodiments, the pressure ratio K, in particular the first pressure ratio $K_7=p_7/p_{7'}$ and/or the first further pressure ratio $K_f=p_7/p_{7f}$ and/or the second pressure ratio $K_8=p_8/p_{8'}$, is or are chosen as a function of the dielectric insulation medium.

In embodiments, the pressure ratio K is a critical pressure ratio K, in particular a first critical pressure ratio $K_7=p_7/p_{7'}$ and/or a first further critical pressure ratio $K_f=p_7/p_{7f}$ and/or a second critical pressure ratio $K_8=p_8/p_{8'}$, that is or are chosen:

in a range of 1.6 to 1.7, when the dielectric insulation medium predominantly contains $SF_6$, or in a range 1.7 to 1.8, when the dielectric insulation medium predominantly or exclusively contains the organofluorine compound in a mixture with a background gas, in particular fluoroketone or C5-fluoroketone in a mixture with at least one of: $CO_2$, $O_2$ and $N_2$.

Choosing the pressure ratio K high is beneficial for providing a high impacting velocity of the impinging gas jets; however it can increase the flow resistance in the travel path of the exhaust gas. Choosing a critical pressure ratio K is optimal, because it allows to reach sonic outflow speed out of the first and/or second outlet opening(s) (which is the maximal achievable speed, without nozzle-shapes being provided at the outlet opening(s)) while maintaining the flow resistance in the travel path at still moderate levels.

A second aspect of the invention relates to an electrical switching device, in particular as described above, having a longitudinal axis z, comprising an arcing volume and at least an arcing contact arrangement with a first arcing contact and a mating second arcing contact, and further comprising an exhaust system with at least one exhaust volume, wherein for closing and opening the electric switching device at least one of the arcing contacts is movable parallel to the longitudinal axis z and cooperates with the other arcing contact, and the electrical switching device comprises a dielectric insulating medium, and wherein inside the exhaust volume at least one intermediate volume is arranged, is enclosed by an intermediate wall, comprises at least one inlet opening for receiving exhaust gas coming from the arcing region, and comprises at least one outlet opening, which outlet opening is facing an opposing wall, in particular of the exhaust volume, and is for producing at least one exhaust gas jet and for discharging it towards and impacting it on the opposing wall, and wherein the switching device has means for changing a size of the intermediate volume, in particular wherein the means are for changing a size of a or the first and/or second intermediate volume.

In embodiments, the means serve for adapting a first intermediate exhaust gas pressure $p_7$ in the first intermediate volume to a second exhaust gas pressure $p_{8'}$ in the second exhaust volume, or to a second intermediate exhaust gas pressure $p_8$ in the second intermediate volume, within a predetermined range of pressure differences, in particular within 0.5 bar and more particularly within 0.4 bar and most particularly within 0.3 bar.

In embodiments, the intermediate volume is delimited by a moveable wall that allows adaptation of a size of the intermediate volume; and/or the first intermediate volume is delimited by a first moveable wall that allows adaptation of a size of the first intermediate volume; and/or the second intermediate volume is delimited by a second moveable wall that allows adaptation of a size of the second intermediate volume.

In embodiments, the intermediate volume, in particular the first intermediate volume and/or the second intermediate volume, is or are designed such that at least temporarily during a time period of arc extinction, in particular during the whole arc extinction period, an additional flow resistance introduced in the exhaust gas comprising the organofluorine compound by the intermediate volume, in particular the first intermediate volume and/or the second intermediate volume, is kept below a threshold flow resistance, below which threshold flow resistance sonic or supersonic flow conditions in the arcing region are maintained, in other words at or above which threshold flow resistance subsonic flow conditions in the arcing region (6) would occur.

In embodiments, a size of the intermediate volume and a position, number and cross-section of the at least one outlet opening are adapted to gas flow characteristics of the organofluorine compound, in particular of the fluoroketone and more particularly to a speed of sound of the fluoroketone gas mixtures, to withhold at least temporarily during a time period of arc extinction a predetermined amount of the exhaust gas inside the intermediate volume, and in particular to achieve a predetermined level of increase of the intermediate exhaust gas pressure(s) $p_7$; $p_8$ in the intermediate volume over the exhaust gas pressure(s) $p_{7'}$, $p_{8'}$ in exhaust volumes downstream of the intermediate volume.

A second aspect of the invention relates to a method for operating an electrical switching device as described herein, wherein an intermediate exhaust gas pressure $p_7$; $p_8$ in one of the intermediate volumes is adjusted, in particular by shifting at least one moveable wall, in such a way that it approximately equals, in particular within a pressure difference of 1 bar or 0.5 bar or less, an intermediate exhaust gas pressure $p_8$; $p_7$ in the other of the intermediate volumes at least temporarily during an arc extinction period; and/or wherein an intermediate exhaust gas pressure $p_7$; $p_8$ in one of the intermediate volumes and/or an intermediate exhaust gas pressure $p_8$; $p_7$ in the other of the intermediate volumes is or are adjusted, in particular by shifting at least one moveable wall (14*a*, 14*b*), in such a way that it is or they are smaller than a third pressure in the arcing volume (6) at least temporarily during an arc extinction period; and/or wherein the first intermediate exhaust gas pressure $p_7$ in the first intermediate volume is adjusted, in particular by shifting the first moveable wall, in such a way that it approximately equals, in particular within a pressure difference of 1 bar or 0.5 bar or less, a second exhaust gas pressure $p_{8'}$ in the second exhaust volume at least temporarily during an arc extinction period; and/or wherein the first intermediate exhaust gas pressure $p_7$ in the first intermediate volume and/or an exhaust gas pressure in the second exhaust volume is or are adjusted, in particular by shifting the first moveable wall, in such a way that it is or they are smaller than a third pressure in the arcing volume at least temporarily during an arc extinction period.

In embodiments, the first intermediate exhaust gas pressure $p_7$ in the first intermediate volume and/or the second intermediate exhaust gas pressure $p_8$ in the second intermediate volume is or are adjusted, in particular by shifting at least one moveable wall along the longitudinal axis z, depending on an intensity of an electric arc forming between the arcing contacts, when they are opened or closed.

In embodiments, the first intermediate exhaust gas pressure $p_7$ in the first intermediate volume and/or a or the second intermediate exhaust gas pressure $p_8$ in the second intermediate volume is or are adjusted, in particular by shifting a moveable wall along the longitudinal axis z, in such a way that a temperature of the dielectric insulating medium is kept lower than a decomposition temperature of the organofluorine compound, in particular the fluoroketone.

The electrical switching device and the method for operating it has the advantage of improved cooling of the insulating and extinguishing fluid located in the switching device, in particular, the adjustment of the size of the exhaust volume provides a flexible way of accounting for different current strengths, ensuring a pressure in the respective exhaust volume which is high enough to create a strong fluid stream, e.g. through the at least one first opening, towards the exterior of the exhaust volume or exhaust volumes. By providing jet-forming openings in the intermediate volume(s) and in particular even a hole array for such openings, it is possible to increase a turbulence of said exhaust gas fluid stream, thus also enhancing the heat transfer capabilities from the fluid to its environment.

The described improvements of the heat transfer capabilities result in several important benefits for an electrical switching device, e.g. a high voltage circuit breaker. One advantage results from the fact that, by keeping the fluid temperature comparatively low, the use of different types of fluids other than $SF_6$ is made even more favourable. As is known, arc extinguishing and insulating gas mixtures (herein simply referred to as "dielectric insulation media") used in high or medium voltage switching devices experience decomposition when heated up above certain levels, which may be encountered under certain operating conditions of said switching devices. This decomposition is undesired, as it reduces the insulating properties of the fluid. $SF_6$ has the property that it recombines when it is cooled down and thereby regains substantially its full dielectric properties; however other gases comprising an organofluorine compound, like the fluoroketone C5, do not exhibit this property. The present invention improves circuit breakers and makes it possible to use also such gases comprising an organofluorine-type compound, because the disclosed subject-matter allows to keep gas temperatures below decomposition temperatures of the organofluorine compound at least in certain areas outside the arcing volume, in particular at least in parts of the first exhaust volume and/or second exhaust volume and/or exterior volume. Thus, the decomposition can be reduced, and for example the degree of decomposition or the concentration ratio of decomposition products to the organofluorine compound in the exhaust gas can be kept below a predetermined threshold value. As a consequence losses of the organofluorine compound can be reduced and maintenance time intervals of the switching device can be increased. Other benefits are the possibility of reducing the size of exhaust volumes.

SHORT DESCRIPTION OF THE DRAWINGS

Figure 2:
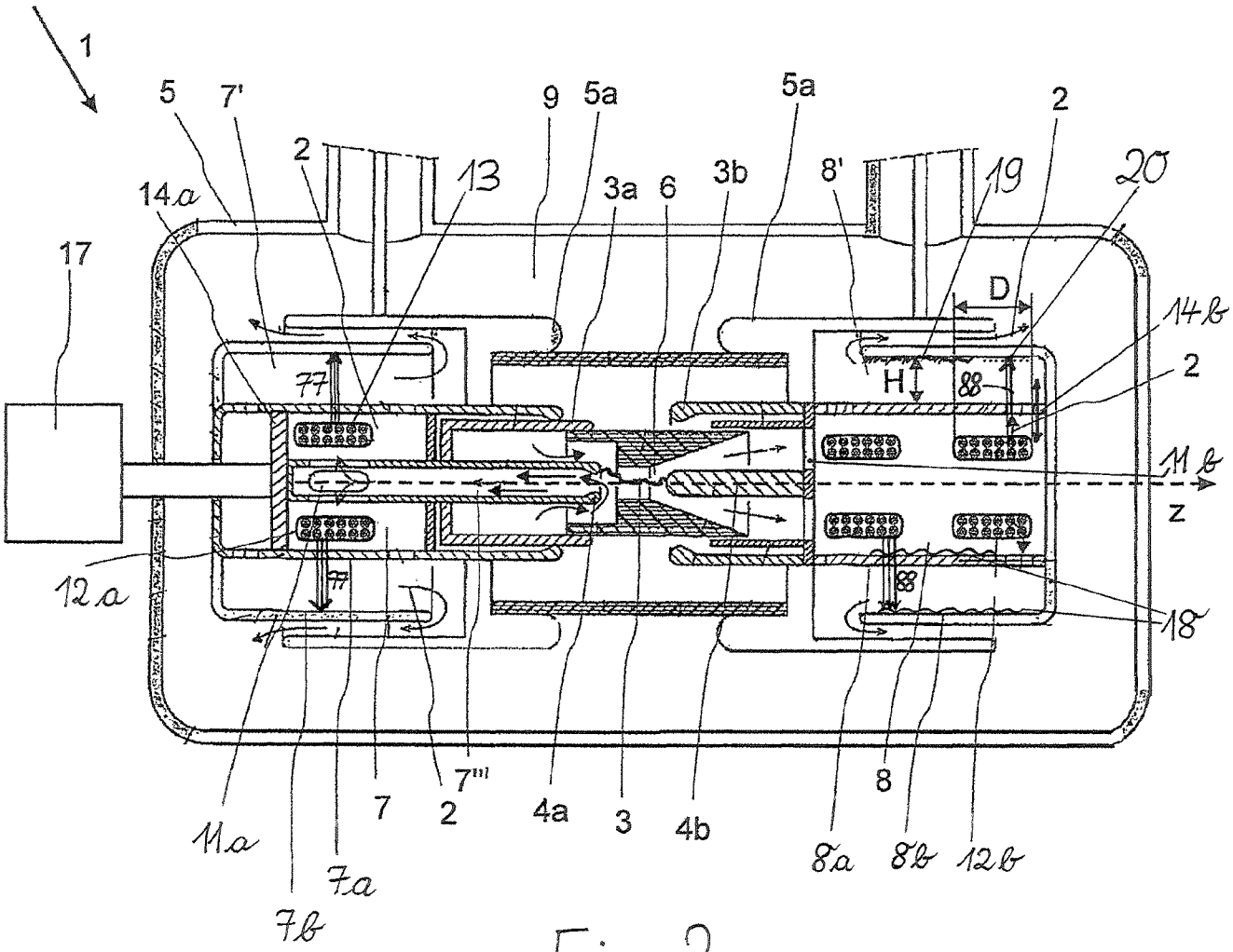
Figure 3:
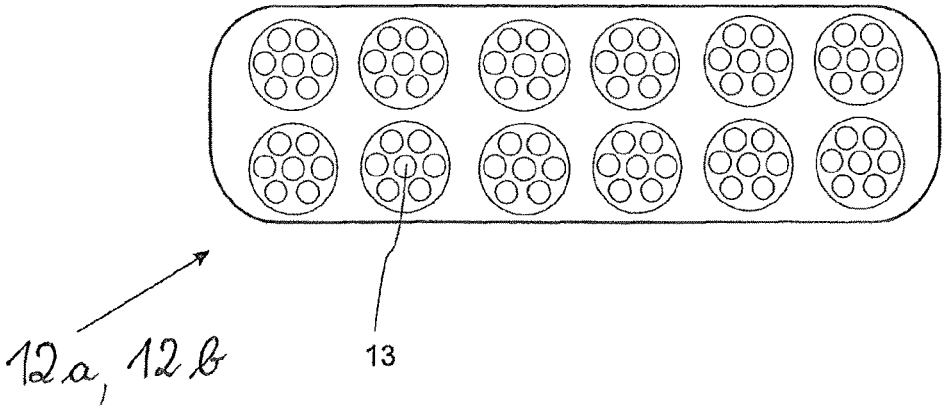
Figure 4:
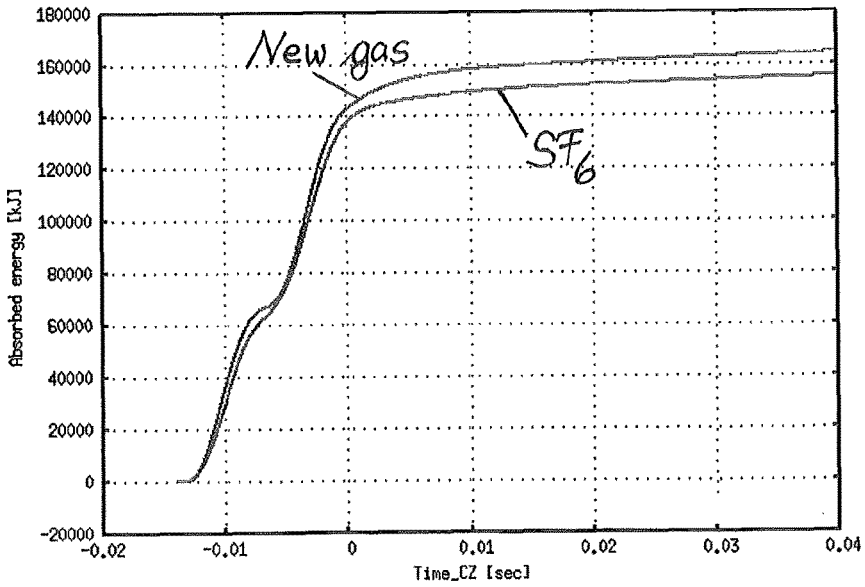
Figure 5:
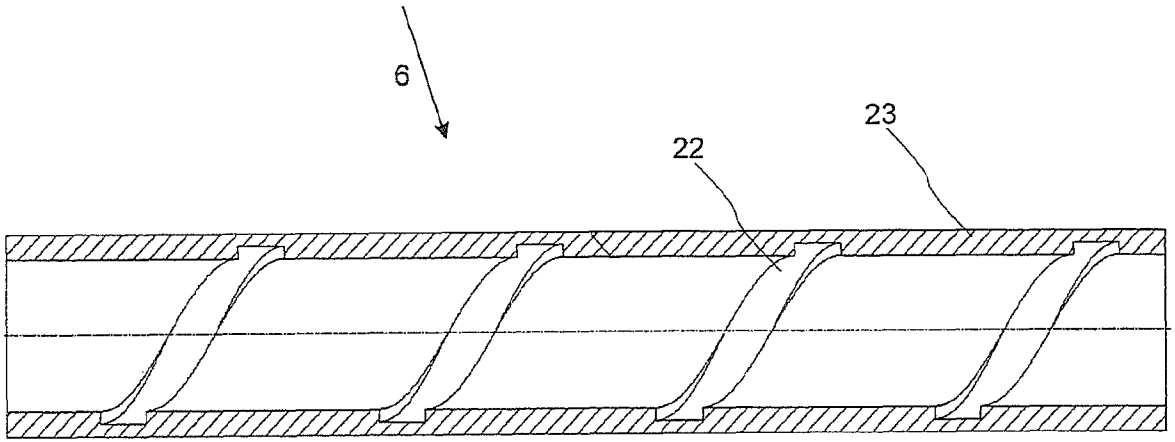

Embodiments, advantages and applications of the invention result from the dependent claims, from claim combinations and from the now following description and figures. It is shown in:

FIG. 1 a sectional view of an embodiment of a high voltage circuit breaker according to the invention;

FIG. 2 a sectional view of another embodiment of a high voltage circuit breaker according to the invention;

FIG. 3 a detailed view of a first opening of an intermediate exhaust volume in the circuit breaker of FIG. 1 or 2, with the opening having an array of jet-forming holes for exhaust gas;

FIG. 4 a graph showing absorbed thermal energy in kilo-Joule versus time after current zero CZ in seconds for novel arc extinction media (here fluoroketone in a mixture with air) compared to conventional $SF_6$; and FIG. 5 a sectional view of inner thread elements that in embodiments can be arranged inside the exhaust tube of the circuit breaker of FIGS. 1 and 2.

WAYS OF CARRYING OUT THE INVENTION

The invention is described for the example of a high voltage circuit breaker with nominal contacts and arcing contacts, but the principles described in the following also apply for using the invention in other switching devices, e.g. of the type mentioned herein. In the following same reference numerals denote structurally or functionally same elements of the various embodiments of the invention.

For the purposes of this document the terms "rightward" and "leftward" are used in connection with a position along the longitudinal axis z, i.e. leftward denotes a relative position in the arrow z direction and rightward denotes a relative position in the opposite arrow z direction. Please note that both leftward and rightward directions are downstream of the arcing volume where the pressure is highest and from where arc-blowing gas and exhaust gas is originating into both leftward and rightward directions.

Switching device means electrical switching device and can encompass, for example, a high-voltage circuit breaker, a generator circuit breaker, a disconnector, a combined disconnector and earthing switch, a load break switch, an earthing device, or a fast-acting earthing device.

FIG. 1 shows a sectional view of an embodiment of a high voltage circuit breaker 1 in an opened configuration. The device 1 can be essentially rotationally symmetric about the longitudinal axis z. Only the elements of the circuit breaker 1 which are related to the present invention will be described in the following, other elements present in the figures are not relevant for understanding the invention. Furthermore a detailed description of the operating principles of the circuit breaker 1 is not given.

A "closed configuration" as used herein means that the nominal contacts and/or the arcing contacts of the circuit breaker 1 are closed (i.e. are touching one another). Accordingly, an "opened configuration" as used herein means that the nominal contacts and/or the arcing contacts of the circuit breaker 1 are opened (i.e. are separated).

The purely exemplary circuit breaker 1 is enclosed by a shell or external enclosure 5 which normally is cylindrical and is arranged around longitudinal axis z. It comprises a nominal contact arrangement 3*a*, 3*b* comprising a first nominal contact comprising a plurality of contact fingers 3*a*, of which only two are shown here for reasons of clarity. The nominal contact fingers 3*a* are formed as a finger cage around the longitudinal axis z. The nominal contact arrangement further comprises a second mating nominal contact 3*b* which normally is a metal tube. A shielding 5*a* can be arranged around the first and the second nominal contact 3*a*, 3*b*. The circuit breaker 1 furthermore comprises an arcing contact arrangement 4*a*, 4*b* comprising a first arcing contact 4*a* and a second arcing contact 4*b*. Analogue to the first nominal contact 3*a* also the first arcing contact 4*a* comprises multiple fingers 4*a* arranged in a finger cage. The second arcing contact 4*b* is normally rod-shaped.

The contact fingers 3*a*, 4*a* are movable relatively to the contacts 3*b*, 4*b* from said closed configuration, in which they are in electrical contact to one another, into the opened configuration shown in FIG. 1, in which they are apart from one another, and vice versa. It is also possible that only one set of the contacts 3*a*, 4*a* or 3*b*, 4*b* respectively, moves parallel to the longitudinal axis z and the other set of contacts 3*b*, 4*b* or 3*a*, 4*a* respectively, is stationary. For the explanatory purposes of the present invention it is assumed that only the first nominal contact 3*a* and the first arcing contact 4*a* are movable along the z-axis and the second nominal contact 3*b* and the second arcing contact 4*b* are stationary. However, the invention is not limited to this configuration.

As mentioned the circuit breaker 1 is shown during an opening process of the electrical switching device 1 in an instant when the distance between the arcing contacts 4*a*, 4*b* is still so small that an electric arc 3 is still present between the arcing contacts 4*a*, 4*b*. For the purpose of this disclosure the area around the electric arc 3 is called arcing volume 6 or heat up area 6.

The first arcing contact 4*a* is attached to an exhaust tube 7''' and the first nominal contact 3*a* is attached to a first intermediate volume 7 which at least partially surrounds the exhaust tube 7'''.

A first exhaust volume 7' is arranged around the first intermediate volume 7. In this embodiment the second arcing contact 4*b* and the second nominal contact 3*b* are attached to a second intermediate volume 8. A second exhaust volume 8' is arranged around the second intermediate volume 8. The enclosure 5 defines an exterior volume 9 surrounding (at least partially or completely) the exhaust tube 7''', the first first intermediate volume 7 and the second intermediate volume 8. The exhaust tube 7''', the first intermediate volume 7, the first exhaust volume 7', the second intermediate volume 8, the second exhaust volume 8' and the exterior volume 9 form a or at least one travel path 2 for a fluid travelling through them. This travel path 2 is illustrated in FIG. 1 by a plurality of arrows, of which only a few have been denoted by the reference numeral 2. It is noted that the electrical switching device 1 may have less or more exhaust volumes or enclosures, depending on its type.

The arcing volume 6 has on the lefthand side fluid connection via the exhaust tube 7''' to the first intermediate volume 7, and on the righthand side via an inner volume 80 surrounding and/or adjacent to the second arcing contact (plug) 4*b* to the second intermediate volume 8, as shown by the respective arrows 2. Thus in particular, at least the arcing volume 6, the first intermediate volume 7, the first exhaust volume 7' and the exterior volume 9 form a first travel path for the exhaust gas, and/or at least the arcing volume 6, the second intermediate volume 8, the second exhaust volume 8' and the exterior volume 9 form a second travel path for the exhaust gas.

In more detail, the exhaust system 7, 7', 7'', 7'''; 8, 8', 8'' comprises a first exhaust volume 7' downstream from the arcing volume 6 on a first side of the switching device 1 having the first arcing contact 4*a*, and inside the first exhaust volume 7' at least one first intermediate volume 7 is arranged, is enclosed by a first intermediate wall 7*a*, comprises a first inlet opening 11*a*, which is for receiving exhaust gas coming from a hollow exhaust tube 7''' fluidly connected to the arcing region 6, and comprises at least one first outlet opening 12*a*, which is facing a first opposing wall 7*b*, in particular of the first exhaust volume 7', and is for producing at least one first gas jet 77 and for discharging it towards and impacting it on the first opposing wall 7*b*. The first intermediate volume 7 is designed such that at least temporarily during a time period of exhaust gas ejection a first intermediate exhaust gas pressure $p_7$ in the first intermediate volume 7 exceeds a first exhaust gas pressure $p_{7'}$ in the first exhaust volume 7' at least by a first pressure ratio $K_7=p_7/p_{7'}$ larger than 1.1.

In embodiments not shown in the figures, the hollow exhaust tube 7''' is mechanically connected to the first arcing contact 4*a* at a second end part, and/or a first further intermediate volume is arranged outside the first intermediate volume 7, is enclosed by a first further intermediate wall, comprises a first further inlet opening 12*a* for receiving exhaust gas coming from the first intermediate volume 7, and comprises at least one first further outlet opening, which is facing a first further opposing wall, in particular of the first exhaust volume 7', and is for producing at least one first further gas jet and for discharging it towards and impacting it on the first further opposing wall, and the first intermediate volume 7 and/or the first further intermediate volume is or are designed such that at least temporarily during a time period of exhaust gas ejection a first intermediate exhaust gas pressure $p_7$ in the first intermediate volume 7 exceeds a first further intermediate exhaust gas pressure $p_{7f}$ in the first further intermediate volume at least by a first further pressure ratio $K_f=p_7/p_{7f}$ larger than 1.1.

In embodiments shown in FIGS. 1 and 2, the exhaust comprises a second exhaust volume 8' downstream from the arcing volume 6 on a second side of the switching device 1 having the second arcing contact 4*b*, and inside the second exhaust volume 8' at least one second intermediate volume 8 is arranged, is enclosed by a second intermediate wall 8*a*, comprises a second inlet opening 11*b*, which is for receiving exhaust gas coming from the arcing region 6, and comprises at least one second outlet opening 12*b*, which is facing a second opposing wall 8*b*, in particular of the second exhaust volume 8', and is for producing at least one second gas jet 88 and for discharging it towards and impacting it on the second opposing wall 8*b*, and the second intermediate volume 8 is designed such that at least temporarily during a time period of exhaust gas ejection a second intermediate exhaust gas pressure $p_8$ in the second intermediate volume 8 exceeds a second exhaust gas pressure $p_{8'}$ in the second exhaust volume 8' at least by a second pressure ratio $K_8=p_8/p_{8'}$ larger than 1.1.

In embodiments, the pressure ratios disclosed herein can be chosen to be critical pressure ratios, i.e. K, $K_7$, $K_{7f}$, $K_8$ between 1.6 and 1.7 for (predominantly) $SF_6$ or between 1.7 and 1.8 for organofluorine compounds with background gas. This assures sonic outflow out of the first intermediate volume 7 and/or second intermediate volume 8 and/or first further intermediate volume.

For the purposes of this disclosure the fluid used in the circuit breaker 1 can be $SF_6$ gas or any other dielectric insulation medium, may it be gaseous and/or liquid, and in particular can be a dielectric insulation gas or arc quenching gas. Such dielectric insulation medium can for example encompass media comprising an organofluorine compound, such organofluorine compound being selected from the group consisting of: a fluoroether, an oxirane, a fluoroamine, a fluoroketone, a fluoroolefin and mixtures and/or decomposition products thereof. Herein, the terms "fluoroether", "oxirane", "fluoroamine", "fluoroketone" and "fluoroolefin" refer to at least partially fluorinated compounds. In particular, the term "fluoroether" encompasses both hydrofluoroethers and perfluoroethers, the term "oxirane" encompasses both hydrofluorooxiranes and perfluorooxiranes, the term "fluoroamine" encompasses both hydrofluoroamines and perfluoroamines, the term "fluoroketone" encompasses both hydrofluoroketones and perfluoroketones, and the term "fluoroolefin" encompasses both hydrofluoroolefins and perfluoroolefins. It can thereby be preferred that the fluoroether, the oxirane, the fluoroamine and the fluoroketone are fully fluorinated, i.e. perfluorinated.

In embodiments, the dielectric insulation medium is selected from the group consisting of: a (or several) hydrofluoroether(s), a (or several) perfluoroketone(s), a (or several) hydrofluoroolefin(s), and mixtures thereof.

In particular, the term "fluoroketone" as used in the context of the present invention shall be interpreted broadly and shall encompass both fluoromonoketones and fluorodiketones or generally fluoropolyketones. Explicity, more than a single carbonyl group flanked by carbon atoms may be present in the molecule. The term shall also encompass both saturated compounds and unsaturated compounds including double and/or triple bonds between carbon atoms. The at least partially fluorinated alkyl chain of the fluoroketones can be linear or branched and can optionally form a ring.

In embodiments, the dielectric insulation medium comprises at least one compound being a fluoromonoketone and/or comprising also heteroatoms incorporated into the carbon backbone of the molecules, such as at least one of: a nitrogen atom, oxygen atom and sulphur atom, replacing one or more carbon atoms. More preferably, the fluoromonoketone, in particular perfluoroketone, can have from 3 to 15 or from 4 to 12 carbon atoms and particularly from 5 to 9 carbon atoms. Most preferably, it may comprise exactly 5 carbon atoms and/or exactly 6 carbon atoms and/or exactly 7 carbon atoms and/or exactly 8 carbon atoms.

In embodiments, the dielectric insulation medium comprises at least one compound being a fluoroolefin selected from the group consisting of: hydrofluoroolefins (HFO) comprising at least three carbon atoms, hydrofluoroolefins (HFO) comprising exactly three carbon atoms, trans-1,3,3,3-tetrafluoro-1-propene (HFO-1234ze), 2,3,3,3-tetrafluoro-1-propene (HFO-1234yf), and mixtures thereof.

The dielectric insulation medium can further comprise a background gas or carrier gas different from the organofluorine compound (in particular different from the fluoroether, the oxirane, the fluoroamine, the fluoroketone and the fluoroolefin) and can in embodiments be selected from the group consisting of: air, $N_2$, $O_2$, $CO_2$, a noble gas, $H_2$; $NO_2$, NO, $N_2O$; fluorocarbons and in particular perfluorocarbons, such as $CF_4$; $CF_3I$, $SF_6$; and mixtures thereof.

In relevant embodiments, a size of the intermediate volume 7, 8 and a position, number and cross-section of the at least one outlet opening 12*a;* 12*b* are adapted to gas flow characteristics of the organofluorine compound, in particular of the fluoroketone and more particularly to a speed of sound of the fluoroketone gas mixtures, to withhold at least temporarily during a time period of arc extinction a predetermined amount of the exhaust gas inside the intermediate volume 7; 8, and in particular to achieve a predetermined level of increase of the intermediate exhaust gas pressure(s) $p_7$; $p_8$ in the intermediate volume 7; 8 over the exhaust gas pressure(s) $p_{7'}$, $p_{8'}$ in exhaust volumes 7'; 8' downstream of the intermediate volume 7; 8.

As mentioned, for such size adaptations the first intermediate volume 7 and/or the second intermediate volume 8 is or are delimited on one side by at least a first wall 14 (exemplarily shown on the left-hand side in FIG. 1, 2) arranged transversally to the longitudinal axis z and shiftable parallel to it by at least an actuation device 15, 16, 17. In the present embodiment, the at least one actuation device comprises at least one spring 16 connecting the actuator 15 to the first wall 14. It is understood that the actuation device 15 may also be formed by a hydraulic or a pneumatic or electric actuation device 15, or it may be a spring itself or even the spring 16. The purpose of this moving first wall 14*a* is to adjust the volume of the first intermediate volume 7 and/or of the second intermediate volume 8 depending on operating parameters of the circuit breaker 1, with the aim of optimizing the fluid flow within the circuit breaker 1, which leads to a more efficient fluid or exhaust gas cooling inside the circuit breaker 1.

For example, the first intermediate volume 7 may be decreased by pushing the first wall 14*a* in the direction of the longitudinal axis z (to the righthand side) in case small currents are expected. In this case a decrease of the first intermediate volume 7 helps to keep up a necessary exhaust fluid or gas pressure and to achieve an optimized impinging jet effect 77 for the exhaust fluid or gas. As a consequence, the exhaust fluid or gas escaping from the intermediate volume 7 or volumes 7, 8 through the first outlet openings 12*a* or second outlet openings 12*b* generates a higher turbulence in the respective first and second exhaust volume 7', 8'. In case of higher currents, in the presence of which more energy is transferred to the fluid or gas, the fluid or gas in the arcing volume 6 has a higher pressure and expansion and may require a larger volume. Thus, the first intermediate volume 7 can be augmented by shifting the first wall 14 in a leftward direction counter or anti-parallel to the longitudinal axis z (rightward direction being denoted by arrow z).

Furthermore, given the spring and actuator system 15, 16, it is possible to achieve to a certain extent a self-regulation of the first and/or the second intermediate volume 7, 8. This is done by shifting the first wall 14*a* to a base position by means of the actuator 15 (or alternatively by providing the base position by a spring or the spring 16 directly). The spring 16 has such a spring rigidity that it permits a volume change of the first and/or the intermediate volume 7, 8 of maximum ±90%, in particular ±70% and more particularly ±50% and most particularly ±30%, with respect to a base volume of the first and/or the second intermediate volume 7, 8 defined by the base position of the first moveable wall 14*a* or second moveable wall 14*b,* respectively. A self-adapting volume change, e.g. within the above limits, occurs as an effect of changing pressures in the respective exhaust volume 7, 8 due to the travelling fluid or exhaust gas.

In other words, a first pressure in one of the intermediate volumes 7, 8 is adjusted in such a way by shifting the moveable wall 14*a* and/or 14*b* that it approximately equals a second pressure of the other intermediate volume 8, 7. This pressure-driven, self-adapting volume change can be achieved by at least one shiftable moveable first and/or second wall 14*a,* 14*b* with any actuator system, e.g. actuator system 15-17, present in the circuit breaker 1. In embodiments, there is one shiftable first wall 14*a* with any actuator system, e.g. actuator system 15-17, present on the left-hand side (as shown in FIG. 1, 2) or on the right-hand side or on both sides of the switching device and in particular circuit breaker 1.

In the following an example is given of how the volume adjustment in a respective intermediate volume 7, 8 is carried out by shifting the first wall 14*a*. Current values and pressure values assumed in this example are exemplary and may vary. Initially, the base position of the first wall 14*a* is set by the actuator 15 before operating the electrical switching device 1, and the pressure in the respective intermediate volume 7, 8 is calculated for 90% of the maximum current, e.g. equal to 50 bar; i.e. the base position is defined by these parameters. The spring rigidity is chosen in such a way that, in operation of the electrical switching device 1, the first wall 14 does not move when the current is lower than 90% of the maximum current. The first wall 14*a* only moves when the current is higher than 90% of the maximum current. In this case, the pressure may e.g. be 60 bar, causing the first wall 14*a* to shift leftward, i.e. in the opposite direction with respect to the arrow z representing the longitudinal axis z. When the pressure drops again to 50 bar or lower the first wall 14*a* moves back into its base position.

Alternatively or additionally, the first pressure in the first intermediate volume 7 and/or in the second intermediate volume 8 is adapted depending on an intensity of the electric arc 3 forming between the arcing contacts 4*a*, 4*b* when they are opened or closed. Advantageously, such measures also contribute to pressure equalization within both the first and second intermediate volume 7 and 8. The pressure equalization is best in an embodiment using moving walls 14*a*, 14*b* coupled to actuators 15-17 for both the first and the second intermediate volume 7, 8.

Alternatively or additionally, the first pressure $p_7$ in the first intermediate volume 7 and/or a second pressure $p_8$ in the second intermediate volume 8 is or are adjusted by shifting the first wall 14*a* and/or the second wall 14*b* in such a way that the first pressure $p_7$ and/or the second pressure $p_8$ is or are smaller than a third pressure in the arcing volume 6. This is desired in order to prevent the fluid or exhaust gas which has escaped into the intermediate volume or volumes 7, 8 to flow back into the arcing volume 6.

In embodiments, the first pressure $p_7$ in the first intermediate volume and/or the second pressure $p_8$ in the second intermediate volume 7, 8 is or are adjusted in such a way that a temperature of the dielectric insulating medium is kept lower than a decomposition temperature of the insulating medium by shifting the respective first wall 14*a*, 14*b* along the longitudinal axis z. As mentioned, the fluoroketone has a decomposition temperature of around 600-900° C. By adjusting the gas pressure in said way it is possible to avoid or diminish its decomposition by the efficient gas cooling of the electrical switching device (in particular circuit breaker 1).

FIG. 4 shows the beneficial effect of using the first intermediate volume 7 in conjunction with the dielectric insulation medium comprising a fluoroketone, specifically gaseous C5-fluoroketone (i.e. comprising exactly 5 carbon atoms), in a mixture with air as background gas. The graphs are showing absorbed thermal energy in kilo-Joule (i.e. exhaust gas cooling) versus time after current zero CZ in seconds for fluorketone-air mixtures (upper curve) compared to conventional $SF_6$ (lower curve). This prooves that the novel arc extinction medium comprising organofluorine compounds have unexpectedly better exhaust gas cooling by an intermediate volume 7, 8 as disclosed herein.

In embodiments schematically shown in FIG. 3, the at least one outlet opening 12*a*; 12*b*, in particular the first outlet opening 12*a* and/or the second outlet opening 12*b*, is or are covered by at least one hole array comprising a plurality of holes 13.

In embodiments, a ratio of a distance H between the intermediate wall 7*a*; 8*a* and the opposing wall 7*b*, 8*b* and an average diameter D of the outlet opening 12*a*; 12*b* is in the range of 1.5 to 8, particularly the ratio has a value of 6; in particular wherein a first ratio of a first distance between the first intermediate wall 7*a* and the first opposing wall 7*b* and an average diameter D of the first outlet opening 12*a* is in the range of 1.5 to 8 or is 6, and/or a second ratio of a second distance between the second intermediate wall 8*a* and the second opposing wall 8*b* and an average diameter D of the second outlet opening 12*b* is in the range of 1.5 to 8 or is 6. In any of these embodiments, a ratio of 6 can be preferred. This ensures an optimized transfer of the fluid or exhaust gas stream from the intermediate volumes 7, 8 into their respective first and/or second exhaust volumes 7', 8'.

FIG. 2 shows a sectional view of another embodiment of a high voltage circuit breaker 1 in an opened configuration. This embodiment is similar to the embodiment described in connection with FIG. 1 with the difference that the first wall 14*a* (here shown for left-hand first intermediate volume 7, but alternatively or in addition equally applicable to right-hand second intermediate volume 8) is actuated in a different way for its movement along the longitudinal axis z. In this embodiment, no actuator and spring are present. Instead the actuation is done by using a drive 17 which is already present in the circuit breaker 1 and is coupled to the nominal and/or arcing contacts 3*a*, 3*b*, 4*a*, 4*b* by a drive rod. This drive 17 has the main task of moving the lefthand contacts, in this example the nominal contact 3*a* and arcing contact 4*a*, during the opening and closing procedures. In this way, also the exhaust tube 7''' is shifted along the longitudinal axis z. The first wall 14*a* is attached to the exhaust tube 7''' and is consequently also moved along with it. While the contacts 3*a*, 3*b*; 4*a*, 4*b* are being closed, the first intermediate volume 7 is decreased until the contacts 3*a*, 3*b*; 4*a*, 4*b* have reached their closed configuration, in which the $1^{st}$ intermediate volume 7 has a minimum size. While the contacts 3*a*, 3*b*; 4*a*, 4*b* are being moved into the opened configuration, the $1^{st}$ intermediate volume 7 is increased until it reaches a maximum size. During the volume increase an underpressure is formed in the respective intermediate volume 7, 8. This helps to additionally suck-in or accelerate the heated fluid or exhaust gas which is travelling out of the arcing volume 6. One advantage of this embodiment is that additional parts like the actuator 15 and the spring 16 of FIG. 1 are not necessary.

In embodiments, the means 14*a*, 14*b*, 15, 16, 17 for changing a size of the intermediate volume 7, 8, in particular the at least one actuation device 17, comprise at least one exhaust tube 7''' arranged inside the first exhaust volume 7' and are attached to the first arcing contact 4*a* and at least one drive 17 of the switching device 1 for moving the exhaust tube 7''' and the first arcing contact 4*a* along the longitudinal axis z, wherein the at least one first moveable wall 14*a* is attached to the exhaust tube 7'''; and/or the first moveable wall 14*a* acts as an exhaust-gas-pressure-driven auxiliary driving-force support for a or the drive 17.

In FIG. 2 the first wall 14*a* is shown as being mounted at one extremity of the exhaust tub 7'''. In other embodiments the first wall 14*a* may also be mounted at another location along the exhaust tube 7'''. The limitation how far it may be mounted on the outer surface of the exhaust tube 7''', as seen in the direction of the longitudinal axis z, is given by a minimum required size of the first intermediate volume 7 and by a position of the openings 11*a* in the exhaust tube 7'''.

FIG. 2 also shows an embodiment of a second wall 14*b* being moveable transversely to the longitudinal axis z. This is, among other possibilities of providing moveable first and/or second moveable walls 14*a*, 14*b*, useful and can be implemented in a relatively simple manner.

FIG. 3 shows a detailed view of an embodiment of one of the first outlet openings 12*a* or second outlet openings 12*b* of FIG. 1 or 2. At least the intermediate wall 7*b* (and/or 8*b*) of the first intermediate volume 7 (and/or of the second intermediate volume 8, respectively) can comprise multiple outlet openings 12*a*, 12*b* of the type shown in FIG. 3. The intermediate wall 7*b*, 8*b* is preferably concentric with respect to the longitudinal axis z. The outlet openings 12*a*, 12*b* are covered by a hole array having a plurality of holes 13.

In embodiments, the holes 13 of the hole array have a cross-section of not more than 50% of an average cross section of the outlet opening 12*a*; 12*b* (without hole array), in particular the first outlet opening 12*a* and/or the second outlet opening 12*b*; and/or the hole array is exchangeable with a hole array having holes 13 with a different diameter.

The fluid or exhaust gas escapes from the first and/or second intermediate volume 7, 8 through said outlet openings 12*a*, 12*b* into the first and/or the second exhaust volume 7', 8', respectively. The advantage of providing outlet openings 12*a*, 12*b* with such a hole array 13 is that the turbulence of the fluid or exhaust gas stream is increased, thus improving heat transfer to metal surfaces of delimiting walls in the path of the fluid or exhaust gas. Furthermore, the exhaust gases can be focused even better onto an impinging wall or baffle wall or opposing wall 7*b*, 8*b*, such as first opposing wall 7*b* of the first exhaust volume 7' or second opposing wall 8*b* of the second exhaust volume 8', arranged opposite of the outlet openings 12*a*, 12*b*, respectively.

In one embodiment a first hole array with first holes 13 is exchangeable with a second hole array having second holes 13 with a different diameter. This is advantageous for adapting the circuit breaker 1 to different or changing operating conditions, e.g. to another fluid used as dielectric insulation and extinguishing medium.

In general embodiments, the first arcing contact 4*a* is an arcing contact tulip 4*a* and the second arcing contact (4*b*) is an arcing contact pin (4*b*); and/or the dielectric insulation medium comprises: an organofluorine compound selected from the group consisting of a fluoroether, a fluoroamine, a fluoroketone, a fluoroolefine, and mixtures thereof; the organofluorine compound being in a mixture with a background gas, in particular selected from the group consisting of: $CO_2$, $O_2$, $N_2$.

In embodiments, that are independent of and applicable to any of the disclosed set-ups, at least one guiding-wall section of the travel path of the exhaust gas is provided with projections 18, 19, 20 (see e.g. exemplarily FIGS. 1 and 2) that extend transversely to the guiding-wall section out of or into the travel path and are for cooling down the exhaust gas. In particular, the projections 18, 19 can be macroscopic projections 18, 19 and can be arranged in a two-dimensional arrangement or two-dimensional matrix at the guiding-wall section and can form a two-dimensional arrangement of vortices in the exhaust gas along the guiding-wall section of the travel path to increase a rate of convective heat transfer from the exhaust gas to the guiding-wall section.

In embodiments, the projections are negative projections 18, 19, 20, in particular uniform dimples 18 or non-uniform dimples 19 or microscopic projections 20, that extend into the guiding-wall section of the travel path; and/or the projections are positive projections 18, 19, 20, in particular uniform positive projections 18 or non-uniform positive projections 19 or microscopic projections 20, extending out of the guiding-wall section of the travel path.

In embodiments, the opposing wall 7*b*, 8*b*, in particular the first opposing wall 7*b* and/or the second opposing wall 8*b*, has or have on its surface uniform dimples 18 or non-uniform dimples 19 or an increased surface roughness 20 forming microscopic projections 20, all for enhancing heat transfer from impinging exhaust gas jets 77, 88 to the opposing wall 7*b*, 8*b*; and/or the opposing wall 7*b*, 8*b*, in particular the first opposing wall 7*b* and/or the second opposing wall 8*b*, is or are made from metal or metal-impregnated ceramic materials.

In embodiments, in the case of surface roughness 20 forming the microscopic projections 20, a mean roughness Ra of the guiding-wall section comprising the microscopic projections 20 is selected in a range of 30 μm to 200 μm and more preferably in a range of 50 μm to 150 μm and most preferably in a range of 70 μm to 120 μm; and/or none of the projections 18, 19 are formed as microscopic projections 20 but instead are macroscopic projections 18, 19 and the macroscopic projections 18, 19 are sufficiently distanced from one another for forming mutually non-interacting vortices in the exhaust gas.

Yet other embodiments are disclosed in FIG. 5, which shows exemplarily a sectional view of at least one inner thread section 22 arranged inside the exhaust tube 6. The inner thread elements 22 are preferably negative projections 22 formed as cavities in the inner wall 23 of the exhaust tube 6. The inner thread section(s) is or are for swirling the exhaust gas inside the hollow exhaust tube (7'''). The exhaust tube 6 is shown in a partial "transparent" way to better illustrate the inner thread or swirl 22. At least a part of the inner thread sections 22 may be connected to one another and may thus form one or more channels 22 in the wall of the exhaust tube 6. This concept of exhaust tube 6 with inner thread section projections 22 or continuous innner thread projections 22 can be implement in any other set-up disclosed herein.

In further embodiments, that are implementable independent of any set-up disclosed herein, at least one deflection device 21 is arranged upstream of the at least one intermediate volume 7, 8 and interacts with the at least one inlet opening 11*a*, 11*b* and is for radial deflection of the exhaust gas into the intermediate volume 7, 8. Specifically, the at least one deflection device 21 can be arranged on a side of the hollow exhaust tube 7''' facing away from the arcing region 6 and can interact with the at least one first inlet opening 11*a* in the hollow exhaust tube 7''' and serves then for radial deflection of the exhaust gas into the first intermediate volume 7.

The present invention improves the capabilities of cooling a fluid or exhaust gas present inside a high or medium voltage switching device 1. By the measures described above, it is possible to reduce the maximum fluid temperature and thus to use alternative insulating and extinguishing fluids of the types described above, i.e. organofluorine compounds as disclosed herein, with reduced risk of a permanent deterioration of fluid characteristics due to too high temperatures. In particular, while the organofluorine compounds present in the arcing volume 6 will be decomposed rather completely, the present invention allows to protect oranofluorine compounds being present outside the arcing volume 6, in particular in the first intermediate volume 7 and/or second intermediate volume 8 and exterior volume 9, to be protected from too high temperatures caused by the exhaust gases and thus from being decomposed. This allows to reduce or minimize the loss of organofluorine compounds occurring during circuit breaker operation.

In a further aspect of the invention (with reference symbols being exemplary only), the electrical switching device 1, in particular as disclosed above, has a longitudinal axis z, comprises an arcing volume 6 and at least an arcing contact arrangement with a first arcing contact 4*a* and a mating second arcing contact 4*b*, and further comprises an exhaust system 7, 7', 7'', 7'''; 8, 8', 8'' with at least one exhaust volume 7'; 8', wherein for closing and opening the electric switching device 1 at least one of the arcing contacts 4*a*, 4*b* is movable parallel to the longitudinal axis z and cooperates with the other arcing contact 4*b,* 4*a,* wherein the electrical switching device 1 comprises a dielectric insulating medium comprising an organofluorine compound selected from the group consisting of fluoronitriles, in particular perfluoronitriles, and mixtures and/or decomposition products thereof, wherein inside the exhaust volume 7'; 8' at least one intermediate volume 7; 8 is arranged, is enclosed by an intermediate wall 7*a;* 8*a,* comprises at least one inlet opening 11*a;* 11*b* for receiving exhaust gas coming from the arcing region 6, and comprises at least one outlet opening 12*a;* 12*b,* which outlet opening 12*a;* 12*b* is facing an opposing wall 7*b,* 8*b,* in particular of the exhaust volume 7'; 8', and is for producing at least one exhaust gas jet 77, 88 and for discharging it towards and impacting it on the opposing wall 7*b,* 8*b,* and wherein the intermediate volume 7; 8 is designed such that at least temporarily during a time period of exhaust gas ejection an intermediate exhaust gas pressure $p_7$; $p_8$ in the intermediate volume 7; 8 exceeds an exhaust gas pressure in its immediately succeeding exhaust volume 7'; 8' at least by a pressure ratio K larger than 1.1.

In embodiments, the fluoronitrile is in a mixture with an organofluorine compound selected from the group consisting of: a fluoroether, an oxirane, a fluoroamine, a fluoroketone, a fluoroolefine, and mixtures and/or decomposition products thereof; in particular the fluoronitrile being in mixtures with a background gas and more particularly in a mixture with a background gas compound selected from the group consisting of: air, air components, nitrogen, oxygen, carbon dioxide, nitrogen oxides.

In embodiments, the fluoronitrile is a perfluoronitrile containing two carbon atoms, three carbon atoms or four carbon atoms, in particular is a perfluoroalkylnitrile, specifically perfluoroacetonitrile, perfluoropropionitrile ($C_2F_5CN$) and/or perfluorobutyronitrile ($C_3F_7CN$), and more particularly is perfluoroisobutyronitrile according to the formula $(CF_3)_2CFCN$ and/or perfluoro-2-methoxypropanenitrile according to the formula $CF_3CF(OCF_3)CN$.

In embodiments of the electrical switching device and of the method for operating such an electrical switching device, the dielectric insulation medium is selected such and the intermediate volume 7; 8 is designed such that at least temporarily during a time period of exhaust gas ejection an intermediate exhaust gas pressure $p_7$; $p_8$ in the intermediate volume 7; 8 exceeds an exhaust gas pressure in its immediately succeeding exhaust volume 7'; 8' at least by a pressure ratio K larger than 1.3, preferably larger than 1.4, more preferably larger than 1.5, more preferably larger than 1.6, and most preferably larger than 1.7. In particular, the pressure ratio K is selected from the group consisting of: a first pressure ratio $K_7$, a first further pressure ratio $K_f$, a second pressure ratio $K_8$, and combinations thereof.

The advantage of choosing the pressure ratio K larger than a threshold value of 1.1, or optionally larger than 1.3 or 1.4 or 1.5 or 1.6 or 1.7, is that with increasing pressure ratio K the exhaust gas jet formation is improved. This results in more gas mass flow and hence better heat transfer to the exhaust system 7, 7', 7", 7'"; 8, 8', 8'" of the electrical switching device 1.

The exhaust gas jet formation will be sonic, as long as the outlet opening 12*a;* 12*b* for jet formation is a hole 12*a;* 12*b,* but may become supersonic, if the outlet opening for jet formation has at least partly a nozzle form 12*a;* 12*b,* and ideally has a laval nozzle form 12*a;* 12*b*. By higher speed of the exhaust gas jet(s) the gas mass flow and hence heat transfer can further be increased.

While there are shown and described presently preferred embodiments of the invention, it is to be distinctly understood that the invention is not limited thereto but may otherwise variously be embodied and practised within the scope of the following claims. Therefore, terms like "preferred" or "in particular" or "particularly" or "advantageously", etc. signify optional and exemplary embodiments only.

LIST OF REFERENCE NUMERALS

1=basic circuit breaker
2=fluid path
3=electric arc
3*a*=contact finger of first nominal contact
3*b*=second nominal contact
4*a*=first arcing contact
4*b*=second arcing contact
5=shell, housing, enclosure
5*a*=shielding
6=arcing volume
7 =first intermediate volume (for creating gas-jets)
7'=first exhaust volume
7"=first outflow channel wall
7'"=exhaust tube
7*a*=wall of first intermediate volume
7*b*=wall of first exhaust volume, first opposing wall
77=first gas jet(s)
8=second intermediate volume (for creating gas-jets)
8'=second exhaust volume
8"=second outflow channel wall
8*a*=wall of second intermediate volume
8*b*=wall of second exhaust volume, second opposing wall
80=inner volume surrounding and/or adjacent to second arcing contact (plug)
88=second gas jet(s)
9=exterior volume, enclosure volume
11*a*=first inlet opening(s) into first intermediate volume, outlet opening of exhaust tube
11*b*=second inlet opening(s) into second intermediate volume
12*a*=first outlet opening (e.g. into first exhaust volume) of first intermediate volume
12*b*=second outlet opening (e.g. into second exhaust volume) of second intermediate volume
13=grid hole
14*a*=first moveable wall of first intermediate volume
14*b*=second moverable wall of second intermediate volume
15=actuator, actuation device (for moveable wall)
16=pressure-equalizing means, resilient means, spring
17=drive of the arcing contacts and the moveable wall
18=uniform dimples
19=non-uniform dimples
20=surface roughness
21=radial deflection device
22=inner thread elements (in exhaust tube)
23=inner wall of exhaust tube
$p_7$=first intermediate exhaust gas pressure in first intermediate volume
$p_{7'}$=first pressure of the exhaust gas downstream of the first intermediate volume, first pressure in first exhaust volume
$p_{7f}$=first further intermediate pressure of the exhaust gas in the first further intermediate volume
$p_8$=second intermediate exhaust gas pressure in second intermediate volume $p_{8'}$=second pressure of the exhaust gas downstream of the second intermediate volume, second pressure in second exhaust volume K=(critical) pressure ratio $K_7$=first (critical) pressure ratio, $p_7/p_{7'}$ $K_{7f}$=first (critical) pressure ratio, $p_7/p_{7f}$ $K_8$=second (critical) pressure ratio, $p_8/p_{8'}$z=longitudinal axis

The invention claimed is:

1. Electrical switching device having a longitudinal axis, comprising an arcing volume and at least an arcing contact arrangement with a first arcing contact and a mating second arcing contact, and further comprising an exhaust system with at least one exhaust volume, wherein for closing and opening the electric switching device at least one of the arcing contacts is movable parallel to the longitudinal axis and cooperates with the other arcing contact, wherein the electrical switching device comprises a dielectric insulating medium comprising an organofluorine compound selected from a group consisting of: a fluoroether, an oxirane, a fluoroamine, a fluoroketone, a fluoroolefine, a fluoronitrile, and mixtures and decomposition products thereof, wherein inside the exhaust volume at least one intermediate volume is arranged, enclosed by an intermediate wall, and comprises at least one inlet opening for receiving exhaust gas coming from an arcing region, and comprises at least one outlet opening facing an opposing wall of the exhaust volume, for producing at least one exhaust gas jet and for discharging the exhaust jet and impacting the exhaust jet on the opposing wall, and wherein the intermediate volume is designed such that at least temporarily during a time period of exhaust gas ejection an intermediate exhaust gas pressure in the intermediate volume exceeds an exhaust gas pressure in its immediately succeeding exhaust volume at least by a pressure ratio larger than 1.1.

2. The electrical switching device according to claim 1, wherein the impacting causes swirling of the at least one exhaust gas jet, wherein the swirling induces turbulent-gas heat transfer to the opposing wall and reduces a temperature and pressure of the swirling exhaust gas jet.

3. The electrical switching device according to claim 1, wherein the organofluorine compound is selected from a group consisting of: perfluoroether, hydrofluoroether, perfluoroamine, perfluoroketone, perfluoroolefin, hydrofluoroolefine, perfluoronitrile, and mixtures thereof with a background gas compound selected from a group consisting of: air, air components, nitrogen, oxygen, carbon dioxide, nitrogen oxides.

4. The electrical switching device according to claim 1, wherein the dielectric insulating medium comprising as the organofluorine compound a fluoroketone having from 4 to 15 carbon atoms, or wherein the fluoronitrile is a perfluoronitrile containing two carbon atoms, three carbon atoms or four carbon atoms.

5. The electrical switching device according to claim 4, wherein the fluoronitrile is at least one of: a perfluoroacetonitrile, perfluoropropionitrile ($C_2F_5CN$), perfluorobutyronitrile ($C_3F_7CN$), perfluoroisobutyronitrile according to the formula $(CF_3)_2CFCN$, perfluoro-2-methoxypropanenitrile according to a formula $CF_3CF(OCF_3)CN$.

6. The electrical switching device according to claim 1, wherein the intermediate volume is designed such that during operation, an exhaust gas pressure is decreasing along a travel path of the exhaust gas from the arcing region through the exhaust system.

7. The electrical switching device according to claim 6, wherein the at least one guiding-wall section of the travel path is provided with projections that extend transversely to the guiding-wall section out of or into the travel path and are for cooling down the exhaust gas, the projections are macroscopic projections and are arranged in a two-dimensional arrangement or two-dimensional matrix at the guiding-wall section and form a two-dimensional arrangement of vortices in the exhaust gas along the guiding-wall section of the travel path to increase a rate of convective heat transfer from the exhaust gas to the guiding-wall section; and the projections are negative projections that extend into the guiding-wall section of the travel path; or the projections are positive projections extending out of the guiding-wall section of the travel path.

8. The electrical switching device according to claim 1, wherein the intermediate volume is designed such that at least temporarily during a time period of exhaust gas ejection an intermediate exhaust gas pressure in the intermediate volume exceeds a pressure in one or more volumes which are downstream of the intermediate volume in a travel path of an exhaust gas through the exhaust system; or that the intermediate volume is designed such that during operation an exhaust gas pressure in the at least one intermediate volume is increased compared to when the at least one intermediate volume were not present.

9. The electrical switching device according to claim 8, wherein a hollow exhaust tube is mechanically connected to the first arcing contact at a second end part, and a first further intermediate volume is arranged outside the first intermediate volume, enclosed by a first further intermediate wall, comprises a first further inlet opening for receiving exhaust gas coming from the first intermediate volume, and comprises at least one first further outlet opening, facing a first further opposing wall, and for producing at least one first further gas jet and for discharging the at least one first further gas jet towards and impacting the at least one first further gas jet on the first further opposing wall, and the first intermediate volume and/or the first further intermediate volume is or are designed such that at least temporarily during a time period of exhaust gas ejection a first intermediate exhaust gas pressure in the first intermediate volume exceeds a first further intermediate exhaust gas pressure in the first further intermediate volume at least by a first further pressure ratio larger than 1.1.

10. The electrical switching device according to claim 8, wherein the pressure ratio is chosen as a function of the dielectric insulation medium.

11. The electrical switching device according to claim 8, wherein the pressure ratio is a critical pressure ration, that is chosen:

in a range of 1.6 to 1.7, when the dielectric insulation medium predominantly contains $SF_6$, or in a range 1.7 to 1.8, when the dielectric insulation medium predominantly or exclusively contains the organofluorine compound in a mixture with a background gas.

12. The electrical switching device according to claim 11, wherein the pressure ratio is in a range 1.7 to 1.8 when the dielectric insulation medium predominately or exclusively is C5-fluoroketone in a mixture with at least one of: $CO_2$, $O_2$ and $N_2$.

13. The electrical switching device according to claim 1, wherein the exhaust system comprises a first exhaust volume downstream from the arcing volume on a first side of the switching device having the first arcing contact, and inside the first exhaust volume at least one first intermediate volume is arranged, enclosed by a first intermediate wall, comprises a first inlet opening, which is for receiving exhaust gas coming from a hollow exhaust tube fluidly connected to the arcing region, and comprises at least one first outlet opening, facing a first opposing wall, and the first intermediate volume is designed such that at least temporarily during a time period of exhaust gas ejection a first intermediate exhaust gas pressure in the first intermediate volume exceeds a first exhaust gas pressure in the first exhaust volume at least by a first pressure ratio larger than 1.1.

14. The electrical switching device according to claim 1, wherein an exhaust comprises a second exhaust volume downstream from the arcing volume on a second side of the switching device having the second arcing contact, and inside the second exhaust volume at least one second intermediate volume is arranged, enclosed by a second intermediate wall, comprises a second inlet opening, for receiving exhaust gas coming from the arcing region, and comprises at least one second outlet opening, which is facing a second opposing wall for producing at least one second gas jet and for discharging the at least one second gas jet towards and impacting the at least one second gas jet on the second opposing wall, and the second intermediate volume is designed such that at least temporarily during a time period of exhaust gas ejection a second intermediate exhaust gas pressure in the second intermediate volume exceeds a second exhaust gas pressure in the second exhaust volume at least by a second pressure ratio larger than 1.1.

15. The electrical switching device according to claim 1 further comprising:

an exterior volume at least partially surrounding the first exhaust volume and the second exhaust volume, wherein at least the arcing volume, the first intermediate volume, the first exhaust volume and the exterior volume form a first travel path for the exhaust gas, or wherein at least the arcing volume, the second intermediate volume, the second exhaust volume and the exterior volume form a second travel path for the exhaust gas.

16. The electrical switching device according to claim 1, wherein the intermediate volume is designed such that at least temporarily during a time period of arc extinction an additional flow resistance introduced in the exhaust gas comprising the organofluorine compound by the intermediate volume is kept below a threshold flow resistance, below which threshold flow resistance sonic or supersonic flow conditions in the arcing region are maintained; or in that a size of the intermediate volume and a position, number and cross-section of the at least one outlet opening are adapted to gas flow characteristics of the organofluorine compound to withhold at least temporarily during a time period of arc extinction a predetermined amount of the exhaust gas inside the intermediate volume, and in particular to achieve a predetermined level of increase of the intermediate exhaust gas pressure in the intermediate volume over the exhaust gas pressure(s) in exhaust volumes downstream of the intermediate volume.

17. The electrical switching device according to claim 1, wherein the at least one outlet opening is covered by at least one hole array comprising a plurality of holes and in that a ratio of a distance between the intermediate wall and the opposing wall and an average diameter of the outlet opening is in the range of 1.5 to 8; or in that the holes of the hole array have a cross-section of not more than 50% of an average cross section of the outlet opening; or the hole array is exchangeable with a hole array having holes with a different diameter.

18. The electrical switching device according to claim 1, wherein the opposing wall has on its surface uniform dimples or non-uniform dimples or an increased surface roughness forming microscopic projections, all for enhancing heat transfer from impinging exhaust gas jets to the opposing wall; and that the opposing wall is made from metal or metal-impregnated ceramic materials; and wherein the case of surface roughness forming the microscopic projections, a mean roughness of the guiding-wall section comprising the microscopic projections is selected in a range of 30 μm to 200 μm or that none of the projections are formed as microscopic projections but instead are macroscopic projections and the macroscopic projections are sufficiently distanced from one another for forming mutually non-interacting vortices in the exhaust gas.

19. The electrical switching device according to claim 1, wherein a hollow exhaust tube has inner thread elements for swirling the exhaust gas inside the hollow exhaust tube; or that at least one deflection device arranged upstream of the at least one intermediate volume interacts with the at least one inlet opening and is for radial deflection of the exhaust gas into the intermediate volume, or that at least one deflection device arranged on a side of the hollow exhaust tube facing away from the arcing region interacts with the at least one first inlet opening in the hollow exhaust tube and is for radial deflection of the exhaust gas into the first intermediate volume.

20. The electrical switching device according to claim 1, wherein the dielectric insulation medium is selected such and the intermediate volume is designed such that at least temporarily during the time period of exhaust gas ejection the intermediate exhaust gas pressure in the intermediate volume exceeds an exhaust gas pressure in its immediately succeeding exhaust volume at least by a pressure ratio larger than 1.3, 1.7; or wherein the least one outlet opening for producing at least one exhaust gas jet and for discharging the exhaust gas jet towards and impacting the exhaust gas jet on the opposing wall is one of a hole or a nozzle.

21. The electrical switching device according to claim 20, wherein the pressure ratio is larger than 1.4.

22. The electrical switching device according to claim 20, wherein the pressure ratio is larger than 1.5.

23. The electrical switching device according to claim 20, wherein the pressure ratio is larger than 1.6.

24. The electrical switching device according to claim 20, wherein the pressure ratio is larger than 1.7.

25. Method for operating an electrical switching device according to claim 1, wherein an intermediate exhaust gas pressure in one of the intermediate volumes is adjusted by shifting at least one moveable wall, in such a way that it approximately equals an intermediate exhaust gas pressure in another of the intermediate volumes at least temporarily during an arc extinction period; or that an intermediate exhaust gas pressure in one of the intermediate volumes and/or an intermediate exhaust gas pressure in another of the intermediate volumes is or are adjusted in such a way that it is or they are smaller than a third pressure in the arcing volume at least temporarily during an arc extinction period.

26. Method according to claim 1, wherein a first intermediate exhaust gas pressure in a first intermediate volume is adjusted in such a way that it approximately equals an exhaust gas pressure in a second exhaust volume at least temporarily during an arc extinction period; and that the first intermediate exhaust gas pressure in the first intermediate volume and/or the exhaust gas pressure in the second exhaust volume is or are adjusted in such a way that it is or they are smaller than a third pressure in the arcing volume at least temporarily during an arc extinction period; and wherein the first intermediate exhaust gas pressure in the first intermediate volume and/or a second intermediate exhaust gas pressure in a second intermediate volume is or are adjusted depending on an intensity of an electric arc forming between the arcing contacts, when they are opened or closed; and wherein the first intermediate exhaust gas pressure in the first intermediate volume and/or the second intermediate exhaust gas pressure in the second intermediate volume is or are adjusted in such a way that a temperature of the dielectric insulating medium is kept lower than a decomposition temperature of the organofluorine compound.

27. The electrical switching device according to claim 1 comprising one of an earthing device, a fast-acting earthing device, a circuit breaker, a generator circuit breaker, a switch disconnector, a combined disconnector and earthing switch, or a load break switch.

28. Electrical switching device having a longitudinal axis, comprising an arcing volume and at least an arcing contact arrangement with a first arcing contact and a mating second arcing contact, and further comprising an exhaust system with at least one exhaust volume, wherein for closing and opening the electric switching device at least one of the arcing contacts is movable parallel to the longitudinal axis and cooperates with the other arcing contact, and the electrical switching device comprises a dielectric insulating medium, and wherein inside the exhaust volume at least one intermediate volume is arranged, enclosed by an intermediate wall, comprises at least one inlet opening for receiving exhaust gas coming from an arcing region, and comprises at least one outlet opening, wherein the outlet opening is facing an opposing wall for producing at least one exhaust gas jet and for discharging the at least one exhaust gas jet towards and impacting the at least one exhaust jet on the opposing wall, wherein the switching device has means for changing a size of the intermediate volume; and wherein the means comprises at least one actuator and at least one spring attached to the actuator for positioning a moveable wall, and wherein a base position of the moveable wall adjustable by one of the actuator or by a base position of the spring, and the spring has such a rigidity that the spring permits a volume change of the intermediate volume within an adaptation range of maximum ±90% with respect to a base volume of the intermediate volume defined by the base position of the moveable wall.

29. The electrical switching device according to claim 28, wherein the means serve for one of adapting a first intermediate exhaust gas pressure in a first intermediate volume to a second exhaust gas pressure in a second exhaust volume, or to a second intermediate exhaust gas pressure in a second intermediate volume, within a predetermined range of pressure differences.

30. The electrical switching device according to claim 29, wherein the pressure differences within 0.5 bar.

31. The electrical switching device according to claim 28, wherein the intermediate volume is delimited by the moveable wall that allows adaptation of the size of the intermediate volume, or a first intermediate volume is delimited by a first moveable wall that allows adaptation of a size of the first intermediate volume, or a second intermediate volume is delimited by a second moveable wall that allows adaptation of a size of the second intermediate volume.

32. The electrical switching device according to claim 28, wherein the means comprises at least one exhaust tube arranged inside a first exhaust volume and attached to the first arcing contact and at least one drive of the switching device for moving the exhaust tube and the first arcing contact along the longitudinal axis, wherein the at least one first moveable wall is attached to the exhaust tube; or that a first moveable wall acts as an exhaust-gas-pressure-driven auxiliary driving-force support for the drive.

33. The electrical switching device according to claim 28, wherein the first arcing contact is an arcing contact tulip and the second arcing contact is an arcing contact pin; or wherein the dielectric insulation medium comprises: an organofluorine compound selected from a group consisting of a fluoroether, a fluoroamine, a fluoroketone, a fluoroolefine, a fluoronitrile, and mixtures and decomposition products thereof; the organofluorine compound being in a mixture with a background gas.

34. The electrical switching device according to claim 28, wherein a first moveable wall or a second moveable wall, is delimiting the intermediate volume on one side and is arranged transversally to the longitudinal axis and shiftable parallel to the longitudinal axis by at least an actuation device.

35. Electrical switching device having a longitudinal axis, comprising an arcing volume and at least an arcing contact arrangement with a first arcing contact and a mating second arcing contact, and further comprising an exhaust system with at least one exhaust volume, wherein for closing and opening the electric switching device at least one of the arcing contacts is movable parallel to the longitudinal axis and cooperates with the other arcing contact, and the electrical switching device comprises a dielectric insulating medium, and wherein inside the exhaust volume at least one intermediate volume is arranged, enclosed by an intermediate wall, comprises at least one inlet opening for receiving exhaust gas coming from the arcing region, and comprises at least one outlet opening, wherein the outlet opening is facing an opposing wall, for producing at least one exhaust gas jet and for discharging the at least one exhaust gas jet and impacting the exhaust gas jet on the opposing wall, wherein the switching device has means for changing a size of the intermediate volume; and wherein a first moveable wall or a second moveable wall, is delimiting the intermediate volume on one side and is arranged transversally to the longitudinal axis and shiftable parallel to the longitudinal axis by at least an actuation device.

36. The electrical switching device according to claim 35, wherein the means serve for one of adapting a first intermediate exhaust gas pressure in a first intermediate volume to a second exhaust gas pressure in a second exhaust volume, or to a second intermediate exhaust gas pressure in a second intermediate volume, within a predetermined range of pressure differences.

37. The electrical switching device according to claim 36, wherein the pressure differences within 0.5 bar.

38. The electrical switching device according to claim 35, wherein the intermediate volume is delimited by a moveable wall that allows adaptation of a size of the intermediate volume, or a first intermediate volume is delimited by a first moveable wall that allows adaptation of a size of the first intermediate volume, or a second intermediate volume is delimited by a second moveable wall that allows adaptation of a size of the second intermediate volume.

39. The electrical switching device according to claim 35, wherein the means comprises at least one actuator and at least one spring attached to the actuator for positioning a moveable wall, and wherein a base position of the moveable wall adjustable by one of the actuator or by a base position of the spring, and the spring has such a rigidity that the spring permits a volume change of the intermediate volume within an adaptation range of maximum ±90% with respect to a base volume of the intermediate volume defined by the base position of the moveable wall.

40. The electrical switching device according to claim 35, wherein the means comprises at least one exhaust tube arranged inside a first exhaust volume and attached to the first arcing contact and at least one drive of the switching device for moving the exhaust tube and the first arcing contact along the longitudinal axis, wherein the at least one first moveable wall is attached to the exhaust tube; or that the first moveable wall acts as an exhaust-gas-pressure-driven auxiliary driving-force support for the drive.

41. The electrical switching device according to claim 35, wherein the first arcing contact is an arcing contact tulip and the second arcing contact is an arcing contact pin; or wherein the dielectric insulation medium comprises: an organofluorine compound selected from a group consisting of a fluoroether, a fluoroamine, a fluoroketone, a fluoroolefine, a fluoronitrile, and mixtures and decomposition products thereof; the organofluorine compound being in a mixture with a background gas.

* * * * *